US007740569B2

(12) United States Patent
Patti

(10) Patent No.: US 7,740,569 B2
(45) Date of Patent: Jun. 22, 2010

(54) WEIGHT-LIFTING APPARATUS AND METHOD OF ASSEMBLING SAME

(76) Inventor: Philip Patti, 3575 Ridge Rd., Templeton, CA (US) 93465

( * ) Notice: Subject to any disclaimer, the term of this patent is extended or adjusted under 35 U.S.C. 154(b) by 0 days.

(21) Appl. No.: 12/050,881

(22) Filed: Mar. 18, 2008

(65) Prior Publication Data

US 2009/0239719 A1 Sep. 24, 2009

(51) Int. Cl.
*A63B 21/072* (2006.01)
*A63B 21/075* (2006.01)

(52) U.S. Cl. ..... 482/107; 482/106; 482/108

(58) Field of Classification Search ..... 482/107, 482/106, 108, 109; 74/543; 403/274; 29/505, 29/521, 525.01, 525.11; 411/180, 339
See application file for complete search history.

(56) References Cited

U.S. PATENT DOCUMENTS 855,463 A 6/1907 Lemp
4,738,446 A 4/1988 Miles
4,878,666 A * 11/1989 Hosoda ..... 473/247
D327,517 S 6/1992 Bowman
5,154,560 A 10/1992 Copito
5,295,934 A 3/1994 Collins et al.
5,346,499 A 9/1994 Garenfeld et al.
5,484,367 A 1/1996 Martinex
5,628,716 A * 5/1997 Brice ..... 482/106
D398,676 S 9/1998 Marney
6,007,268 A 12/1999 Whittington et al.
6,059,700 A 5/2000 Ellenburg
6,602,169 B1 * 8/2003 Patti ..... 482/107
D486,536 S * 2/2004 Patti ..... D21/681
7,131,938 B2 * 11/2006 Cao ..... 482/106

OTHER PUBLICATIONS

"Security Locknuts—Designed to hold your business together," Product Brochure, Security Locknut Inc., Chicago, Illinois 60656.

* cited by examiner

*Primary Examiner*—Loan H Thanh
*Assistant Examiner*—Shila Abyaneh

(57) ABSTRACT

A fixed weight/permanent weight-lifting apparatus including dumbbells and barbells is provided including an elongated shaft having threaded ends, a centrally located handle, collars distal the threaded ends and tapered splines between the threaded ends and the collar and a head to provide the fixed weight of the apparatus that has been forced onto each end of the elongated shaft and a nut securely fastened on each of the threaded ends. When the nut is tightened onto each end with sufficient torque, the tapered spline is forced into the head and forms grooves in the head that correspond to ridges in the spline, which has a higher tensile strength than that of the head.

19 Claims, 2 Drawing Sheets

WEIGHT-LIFTING APPARATUS AND METHOD OF ASSEMBLING SAME

BACKGROUND OF THE INVENTION

1. Field of Invention

The present invention relates generally to weight-lifting apparatus and a method of assembling the apparatus, and more particularly to fixed dumbbells and barbells and a method of assembling to insure the user's safety after the apparatus has undergone heavy commercial use.

2. Description of the Prior Art

Fixed dumbbells and barbells are those in which the individual weights or heads cannot be added or subtracted by the user, but are permanently fixed to each end of a handle or bar. Fixed dumbbells and barbells have been used for over 50 years in commercial exercise environments such as health clubs, gyms, schools, YMCAs and the like. Under such heavy commercial use, the heads on the fixed dumbbells and barbells become loose on the handle causing the heads to rotate. The moment the heads begin to loosen, the user has insecurities concerning the safety of the equipment. The goal in assembling such weight-lifting equipment is to prevent the heads from becoming loose.

Patti, U.S. Pat. No. 6,602,169 (the '169 Patent), offered a solution to the foregoing problem by disclosing and claiming a method for placing a single locking nut on threaded ends of the handle.

It has been found that even with the improvement offered in the '169 Patent, the problem of rotation still exists. There is a need for improvements in dumbbell and barbell design to eliminate such rotation.

SUMMARY OF THE INVENTION

One embodiment of the present invention is weight-lifting apparatus, which includes (a) an elongated shaft having threaded ends, a centrally located handle, a tapered spline adjacent each of the threaded ends, and a collar between the handle and each spline; (b) a head that is mounted with force to each end of the handle; (c) a nut fastened to each of the threaded ends. The shaft and the heads are constructed of a metal selected from the group consisting of steel, cast iron and mixtures thereof. The shaft has a tensile strength greater than 110,000 psi and the head has a tensile strength less than that of the handle.

The tapered spline is a series of uniformly spaced ridges on the shaft, parallel to its axis and that fit inside corresponding grooves forced into the head because of this differential in tensile strength.

Another embodiment of the present invention is a method for assembling weight-lifting apparatus, which includes the following steps:

a) providing the shaft described above, the head described above and that has a first centrally located opening on its inner face for receiving the tapered spline and a second centrally located opening on its outer face; and the nut to be housed within the second located opening;
b) placing the head so that a portion of the threaded end of the shaft extends through the first centrally located opening and into the second centrally located opening;
c) placing the nut on each of the portions of the threaded ends extending into the second centrally located openings; and
d) applying sufficient torque to each of the nuts to force each of the tapered splines entirely within the second centrally openings until each of the collars abuts each of the inner surfaces of said head and after grooves have been formed in these second openings to correspond to ridges in the splines.

DESCRIPTION OF THE PREFERRED EMBODIMENTS

Figure 1:
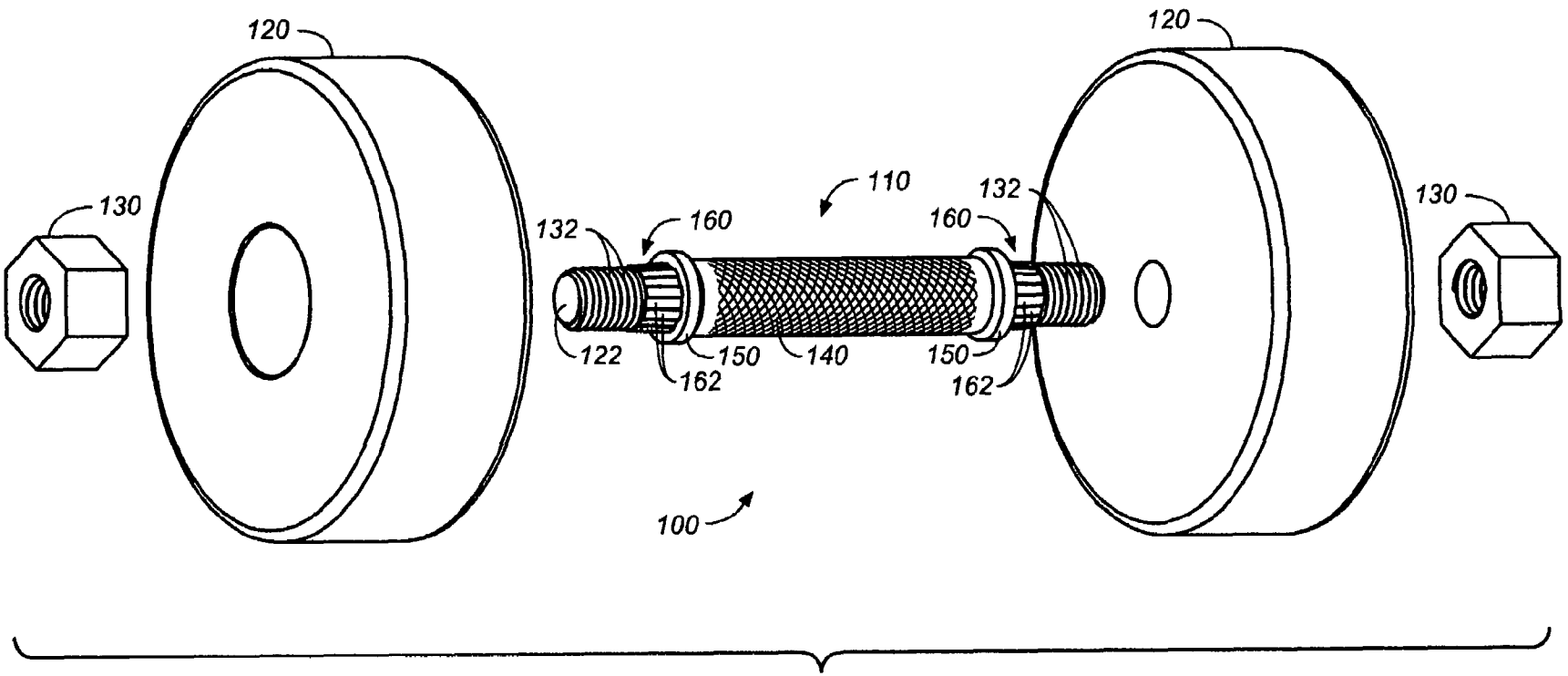
FIG. 1 an exploded perspective view of the weight-lifting apparatus of the present invention.

Referring now to FIG. 1, there is illustrated the disassembled arrangement of the weight-lifting apparatus 100. Weight-lifting apparatus 100 includes elongated shaft 110, a pair of heads 120 at each threaded end 122 of shaft 110 and nuts 130 that are to be tightened on each end 122 of shaft 110. Each end 122 has threads 132 to receive nut 130. Between the ends 122 of shaft 110 are centrally located handle 140 and collars 150. Between collars 150 and the threaded ends 122 are tapered splines 160 having uniformly spaced ridges 162 around the horizontal axis of splines 160.

The weight-lifting apparatus of the present invention includes fixed weight/permanent weight dumbbells and barbells. In the case of dumbbells, a user's hands are placed around the center section or handle of a pair of dumbbells. The handle of a dumbbell is usually approximately 5½-6 inches long. In the case of a barbell, both of the user's hands are placed on the handle, which has a length of approximately 36 to 48 inches. The handles in each case can be knurled as shown in FIGS. 1, 2A and 2B to allow for a better fit for the user's hand.

Figure 2B:
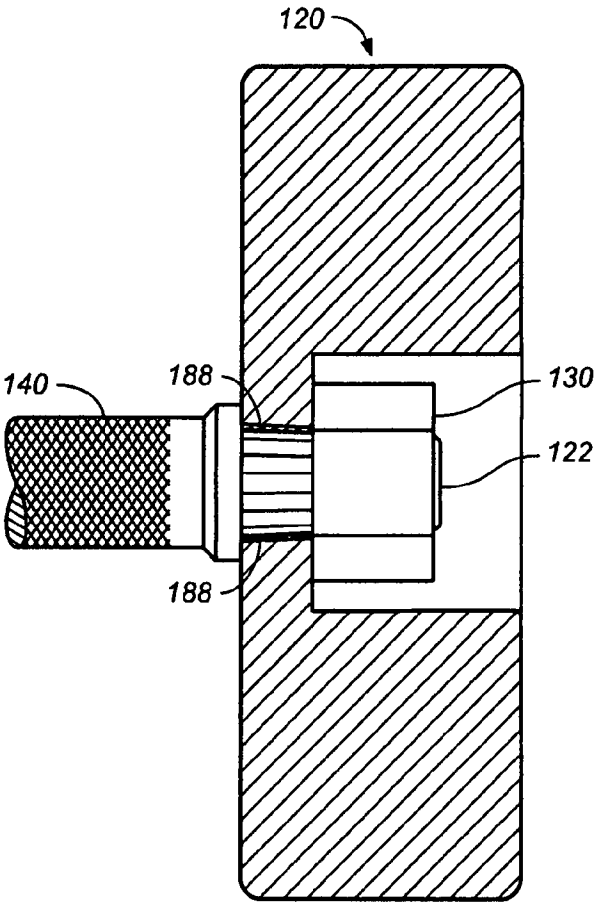
FIG. 2B is a cross sectional view of the right end of weight-lifting apparatus in which the head is shown assembled onto the handle.
Figure 2A:
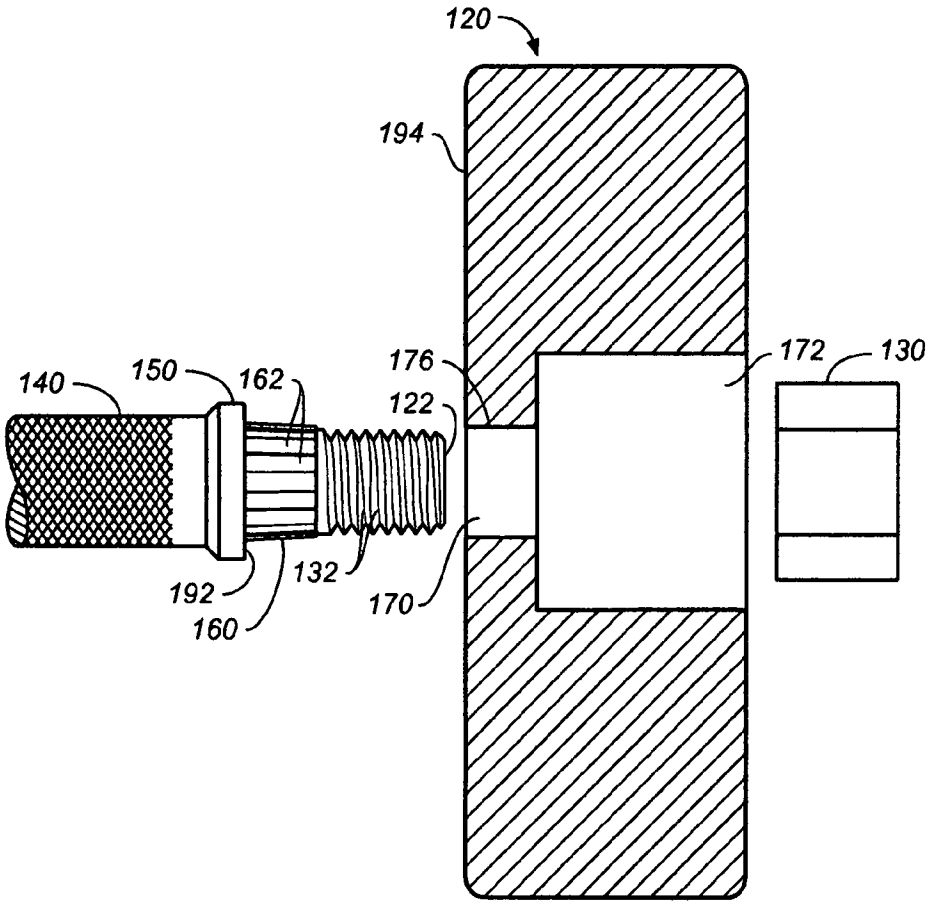
FIG. 2A is a cross sectional view of the right end of weight-lifting apparatus shown in FIG. 1.

FIG. 2A illustrates the disassembled right end of weight-lifting apparatus 100 in which threaded end 122 is positioned to be inserted through first centrally located opening 170 and part way into second centrally located opening 172 until tapered spline 160 prevents further entry without force. The differential between the diameter of opening 170 the largest diameter of spline 160, which is immediately adjacent collar 150 is critical and should be at least 0.030 inch. The diameter of 172 is sufficient to receive nut 130 and to allow space for a wrench or other similar tool not shown.

FIG. 2B illustrates the assembled right end of weight-lifting apparatus 100 in which nut 130 has been threaded onto end 122. Nut 130 is threaded onto end 122 with a torque wrench that applies sufficient torque to force the entire length of spline 160 into opening 170. As a result of this force, the uniformly spaced ridges 162 of spline 160 form corresponding uniformly spaced grooves 188 within the walls 176 of opening 170. It is important that spline 160 is tapered toward opening 170. The force is applied until outer face 192 of collar 150 abuts inner surface 194 of head 120. Spline 160 is then within the outer length of opening 170 and threaded end 130 is completely within opening 170.

Although cast iron and standard steel can be used in the construction of the head and shaft of the weight-lifting apparatus of the present invention, the shaft is preferably a special type of steel having a tensile strength in the range of about 120,000 to about 135,000 psi. The heads are constructed from a solid block of metal and contain no welds as in many prior art weight-lifting apparatus. Still more preferably, this material is a specially fabricated 1045 stress relieved, cold drawn steel. The heads can include a standard 1018 steel or similar low carbon steel. It is critical that the tensile strength of the head is at least 20,000 psi less than that of the handle. In other words, the differential between the head and the handle is at least 20,000 psi. Preferably, the head has a tensile strength in the range of about 55,000 to about 75,000 psi. This differential permits the assembler to easily force the tapered spline into the opening in the head as described above. The foregoing method results in weight-lifting apparatus that eliminates the possibility that the head will rotate on the shaft even after heavy commercial use.

Nut 130 can be a standard nut. Preferably 130 is a locking nut, which comprises a nut body and a spring steel oblong threaded insert located within the nut body. The locking nut is described in the '169 Patent, which description is incorporated herein by reference. The specific locking nut that is used in the preferred embodiment is one that is available from Security and Locknut, Inc., Chicago, Ill., 60656.

The improvement of the current weight-lifting apparatus over the apparatus disclosed and claimed in the '169 Patent is that the head of the present apparatus does not rotate around the shaft. While the locking nut in the case of the '169 Patent remains on the shaft, under heavy commercial use the head becomes loose from the shaft because of surface compression and allows the head to rotate the shaft. Weight-lifting apparatus 100 is designed to eliminate this rotational activity even after lifting apparatus encounters severe dropping over long periods of time and the head becomes loose. The higher tensile strength steel used in the shaft allows the assembler to form the grooves in the less tensile strength of the head so that there is substantially no deformation of the shaft during the assembly of the head onto the shaft. Even if the head is compressed due to severe shock loads, the interference between the spline of the shaft and the head prevents the head from spinning in a rotational manner. Even if the nut is completely removed, it has been found that the head will not rotate.

In the method of the present invention for assembling weight-lifting apparatus 100, ends 122 are placed through openings 170 until a portion of the threads of threaded ends are within openings 172. Nuts 130 are then mounted on that portion of the threads within openings 172 and tightened onto ends 122. As nuts 130 are tightened with sufficiently high torque, splines 160 are drawn through the entire length of openings 172 so that inner surfaces 192 of collars are adjacent to inner surfaces 194 of heads 120. The torque necessary to form grooves 188 depends on the tensile strength differential between heads 120 and splines 160 and the differential between the largest diameter of splines 160 and the diameter of openings 170. For example, a dumbbell was assembled having a tensile strength differential of about 60,000 psi, the largest diameter of the spline of 1.125 diameter and the diameter of opening to receive the spline of 1.070 inch. The nuts were easily threaded onto the threaded shaft using an impact socket wrench, which produced at least 200 pounds of force. The net result is that heads remain on the shaft without spinning even if nuts are removed.

Without departing from the spirit and scope of this invention, one of ordinary skill in the art can make many other changes and modifications to the weight-lifting apparatus the present invention to adapt to specific uses and conditions. As such, these changes and modifications are properly, equitably and intended to be, within the full range and equivalence of the following claims.

What is claimed is:

1. Weight-lifting apparatus comprising:

a) an elongated shaft having threaded ends, a centrally located handle, a tapered spline adjacent each of said threaded ends and having a series of uniformly spaced ridges on the shaft that are parallel to its axis, a collar between said handle and each spline, and a tensile strength greater than 110,000 psi;

b) two heads having a tensile strength less than 110,000 psi, each of said heads having a first opening on its inner face and a second opening on its outer face and mounted to each end of said shaft forcing the spline into the first opening of each of the heads to create grooves within the heads that correspond to ridges of the spline with substantially no deformation of the shaft during assembling because of the tensile strength differential between the shaft and the heads, resulting in the apparatus having heads that after being compressed due to severe shock loads and heavy commercial use are prevented from rotating on the shaft because of an interference between the splines and the heads;

c) a nut within the second opening of each of the heads and threadably fastened to each of said threaded ends of said shaft; and d) whereas the resulting apparatus has heads that after being compressed due to severe shock loads and heavy commercial use are prevented from rotating on the shaft because of the interference between the spline and the heads and even after the nuts are removed, the heads will not rotate;

said shaft and said heads are constructed of a metal selected from the group consisting of steel, cast iron and mixtures thereof.

2. The weight-lifting apparatus of claim 1, wherein said shaft and said heads are constructed of steel.

3. The weight-lifting apparatus of claim 2, wherein said steel is a stress relieved, cold drawn steel.

4. The weight-lifting apparatus of claim 1, wherein the tensile strength differential between that of said shaft and said heads is at least 20,000 psi.

5. The weight-lifting apparatus of claim 1, wherein said nut is a locking nut.

6. The weight-lifting apparatus of claim 1, wherein said handle is knurled.

7. The weight-lifting apparatus of claim 1, wherein each of said heads has a first centrally located opening on its inner face for receiving the threaded end of said shaft and a second centrally located opening on its outer face to house said nut.

8. The weight-lifting apparatus of claim 7, wherein the largest diameter of said tapered spline is at least 0.05 larger than the diameter of the first centrally located opening.

9. The weight-lifting apparatus of claim 1, wherein each of said heads is constructed of a solid block of metal.

10. The weight-lifting apparatus of claim 4, wherein said shaft has a tensile strength in the range of about 120,000 to about 135,000 psi and said head has a tensile strength in the range of about 55,000 to about 75,000 psi.

11. A method of assembling weight-lifting apparatus comprising the steps of:

a) providing an elongated shaft having threaded ends, a centrally located handle, a tapered spline adjacent each of said threaded ends and having a series of uniformly spaced ridges on the shaft that are parallel to its axis, a collar between the handle and each spline, and a tensile strength greater than 110,000 psi; two heads for mounting onto each of the splines of said shaft, each of said heads having a tensile strength less than 110,000 psi, a first centrally located opening on its inner face for receiving the tapered spline and a second centrally located opening on its outer face; and a nut to be housed within the second located opening after being threaded onto each of the threaded ends of said shaft;

b) placing each of said heads so that a portion of the threaded end of the shaft extends through the first centrally located opening and into the second centrally located opening;

c) placing a nut on each of the portions of the threaded ends extending into the second centrally located openings;

e) applying sufficient torque to each of said nuts to force each of the tapered splines entirely within the first centrally located openings until each of the collars abuts each of the inner surfaces of said heads and after grooves have been formed in the first located openings to correspond to the ridges in the splines with substantially no deformation of the shaft during assembling because of the tensile strength differential between the shaft and the heads, resulting in the apparatus having heads that after being compressed due to severe shock loads and heavy commercial use are prevented from rotating on the shaft because of an interference between the spline and the heads; and f) whereas the resulting apparatus has heads that after being compressed due to severe shock loads and heavy commercial use are prevented from rotating on the shaft because of the interference between the spline and the heads and even after the nuts are removed, the heads will not rotate.

12. The method of claim 11 wherein said shaft and said heads are constructed of steel.

13. The method of claim 12, wherein said steel is a stress relieved, cold drawn steel.

14. The method of claim 11, wherein the tensile strength differential between that of said shaft and said heads is at least 20,000 psi.

15. The method of claim 14, wherein said shaft has a tensile strength in the range of about 120,000 to about 135,000 psi and said head has a tensile strength in the range of about 55,000 to about 75,000 psi.

16. The method of claim 11, wherein said nut is a locking nut.

17. The method of claim 11, wherein said handle is knurled.

18. The method of claim 11, wherein the largest diameter of said tapered spline is at least 0.05 larger than the diameter of the first centrally located opening.

19. The method of claim 11, wherein each of said heads is constructed of a solid block of metal.

* * * * *